United States Patent [19]

Houn

[11] 4,292,755

[45] Oct. 6, 1981

[54] AIR FLOATING SAUCER TOY

[76] Inventor: Lin P. Houn, No. 6, La. 107, Sec. 1, Tzu Yen Rd., Shih Pai, Peitou, Taipei, Taiwan

[21] Appl. No.: 60,785

[22] Filed: Jul. 25, 1979

[51] Int. Cl.[3] ..... A63H 29/16

[52] U.S. Cl. ..... 46/44; 46/249

[58] Field of Search ..... 46/1 J, 44, 56, 76, 46/249, 53; 272/31 A; 40/477, 480; 434/140, 291, 292

[56] References Cited

U.S. PATENT DOCUMENTS

| | | | |
|---|---|---|---|
| 2,074,363 | 3/1937 | Burke | 46/44 X |
| 2,897,607 | 8/1959 | Park | 46/56 X |
| 2,924,033 | 2/1960 | Lanctot | 46/76 R X |
| 3,082,570 | 3/1963 | Pearson | 46/44 |
| 3,083,497 | 4/1963 | Novak et al. | 46/44 |

FOREIGN PATENT DOCUMENTS

| | | | |
|---|---|---|---|
| 558822 | 9/1932 | Fed. Rep. of Germany | 46/76 R |

*Primary Examiner*—F. Barry Shay

*Attorney, Agent, or Firm*—Richards, Shefte & Pinckney

[57] ABSTRACT

This invention relates to an air-floating saucer toy, comprising a housing, of which the main dynamic elements including saucer, air pump, electric motor, speed-reducing device, pneumatic tube and batteries are carried. The saucer is driven to float along a circular slot in the housing by the pneumatic discharge from the air pump through an injection nozzle at the outer end of the pneumatic tube, which travels in a circular path below the slot, the saucer thereby moving along an orbit corresponding with the slot and in the same direction as the end of the tube.

6 Claims, 4 Drawing Figures

AIR FLOATING SAUCER TOY

BACKGROUND OF THE INVENTION

The present invention relates to an air-floating saucer toy and more particularly to a toy having a saucer floating and rotating above the main housing of the toy through an air-pump. The main dynamic elements including the air pump, electric motor, speed-reducing device, pneumatic tube and batteries are mounted in the housing for driving the saucer by pneumatic discharge from the end of the tube for floating along the circular orbit corresponding to the slot on the housing and enhancing the enjoyment in the use of the toy.

A conventional saucer toy is generally an individual saucer body, of which the dynamic source is by the player's hands for throwing the same, which becomes uninteresting after an extended period of time and requires a large playing area.

Other dynamic saucer toys of remote control are available, but they are expensive, complicated and require a large playing area. In contrast, the present invention eliminates the foregoing disadvantages and provides an interesting saucer toy of a floating type. The present invention also provides a desirable saucer toy of low cost which can be played at any place without any limitation of the playing place.

SUMMARY OF THE INVENTION

Briefly described, the present invention provides an air-floating saucer toy having a housing in which are mounted an air pump, an electric motor, electrical batteries for powering the motor and pump, a speed-reducing device driven by the motor, a connector rotated by the speed-reducing device, and a radially extending pneumatic tube that is connected to the connector and has an outer end that rotates in a circular path below a circular slot in the housing. The end of the pneumatic tube directs a pneumatic discharge upwardly through the slot and a saucer is acted on by the pneumatic discharge for floating above the slot and travel with the outer end of the pneumatic tube in a circular orbit above the slot.

Preferably the outer end of the pneumatic tube is formed with perforations for directing the pneumatic discharge upwardly through the slot, the housing includes a transparent cover to prevent escape of the orbiting saucer, the outer end of the discharge tube is inclined in the direction of travel to maintain contrtol of the moving saucer, the pneumatic tube extends into the connector and has holes therein for passage of the discharge from the pump thereinto, and the saucer is provided with an opening at the bottom and an annular series of holes to permit discharge of a limited portion of the pneumatic discharge therethrough for smooth control of the saucer during startup and continued operation.

All of these features and advantages are obtained in an inexpensive and simple construction that provides enhanced playing enjoyment.

DETAILED DESCRIPTION OF THE PREFERRED EMBODIMENT OF THE INVENTION

Figure 1:
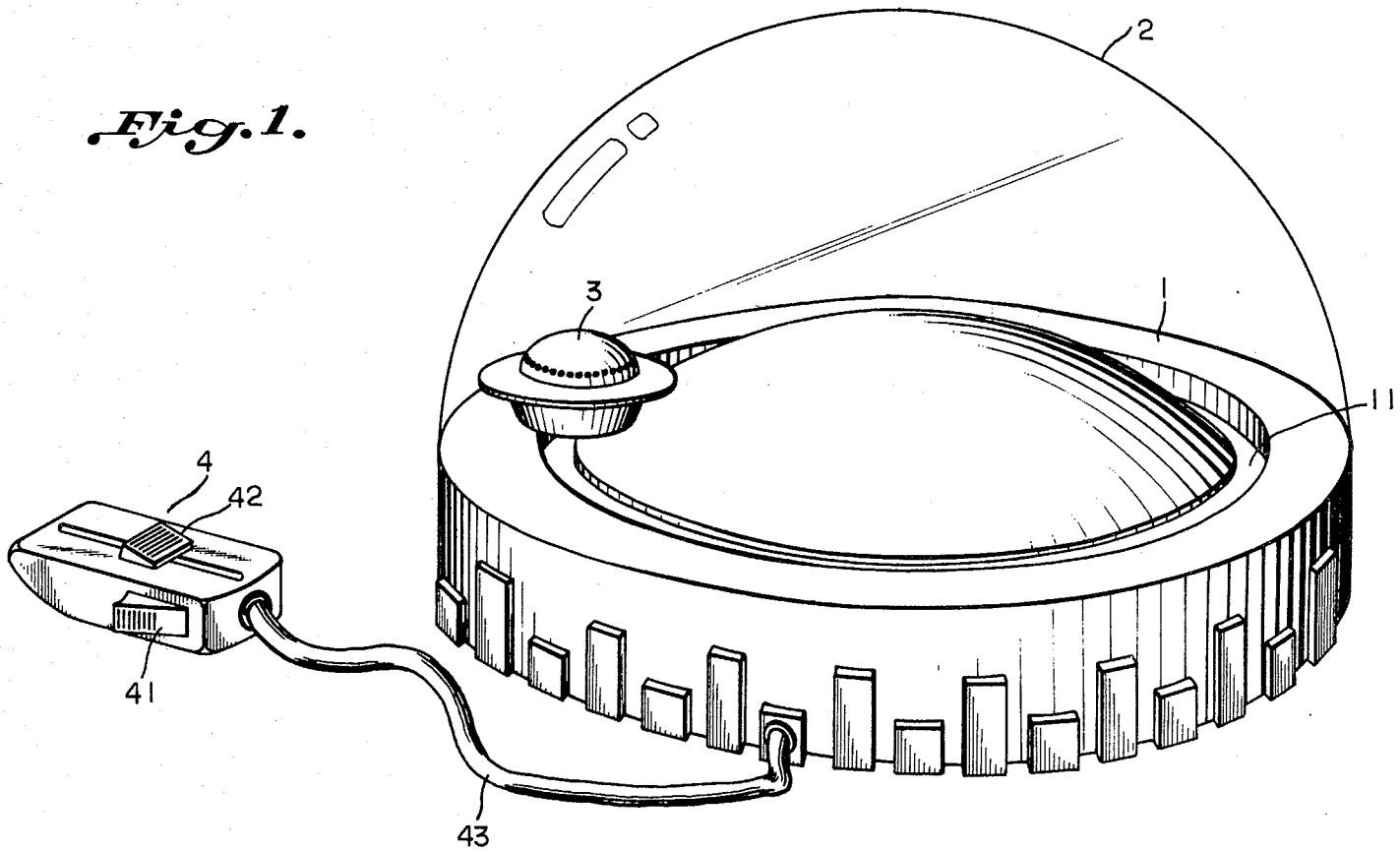
FIG. 1 is a perspective view of an air-floating saucer toy according to the present invention.

The present invention may be better understood by referring to the drawings. FIG. 1 shows a perspective view of the air-floating saucer toy according to the present invention, which includes a housing (1) with a circular slot (11) therein, and a transparent cover (2) mounted thereon. A saucer (3) is located along the circular slot (11) thereof, and an electrical control wire (43) extends from the housing with switches (41), (42) at the outer end thereof for determining the on-off of the toy by punching the switch (41) and determining the air pressure by punching the switch (42).

Figure 2:
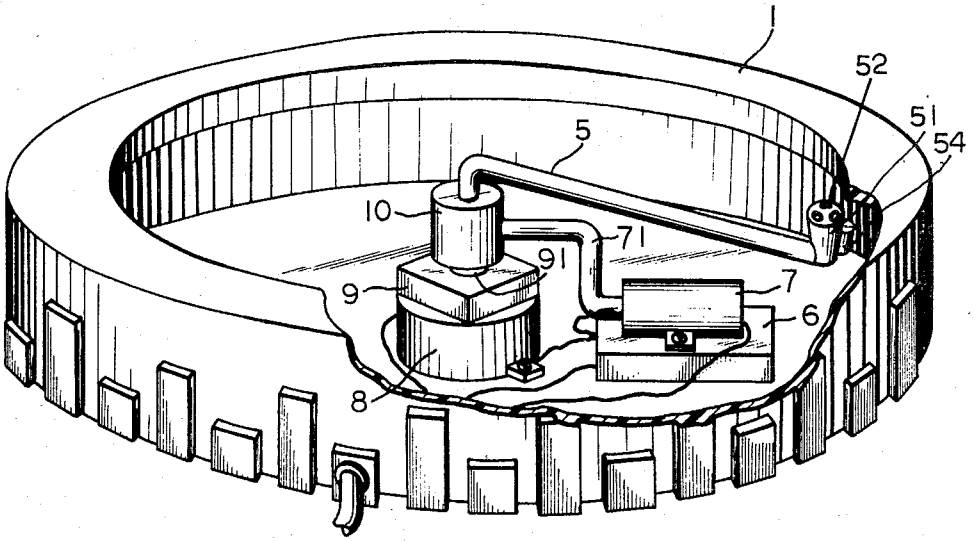
FIG. 2 is a partial perspective view, partially broken away, of the floating saucer toy of FIG. 1.
Figure 3:
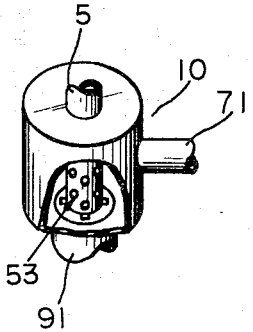
FIG. 3 is an enlarged perspective view, partially broken away, of the connector portion of the air-floating saucer toy of FIG. 1.

FIG. 2 shows a speed-reducing device (9), which is meshed to an electric motor (8) for decreasing the rate of rotation of a shaft driven by the motor through the speed-reducing device. Stationarily mounted on the shaft (91) is a connector (10) that has connected thereto a radially extending pneumatic tube (5) (see FIG. 3). An air pump (7) is mounted in the housing (1) between electrical batteries (6), and a pneumatic conduit (71) connects the pump (7) and the connector (10). The radially inward end of the pneumatic tube (5) is rotatably journaled in and extends through the connector (10) and is joined to the shaft (91) such that the rotation of the shaft (91) drives the pneumatic tube (5) to move circularly through the action of the speed-reducing device (9), all as is seen in FIG. 3. As can also be seen from FIG. 3, the radially inward end portion of pneumatic tube (5) extending through connector (10) is provided with a plurality of orifices (53) for transmission into the tube (5) of the pneumatic output of the air pump (7) conveyed into the connector (10) through conduit (71). At the outer end of the pneumatic tube a perforated nozzle (51) is formed with three orifices (52). A lamp (54) is also mounted on the tube outer end.

Figure 4:
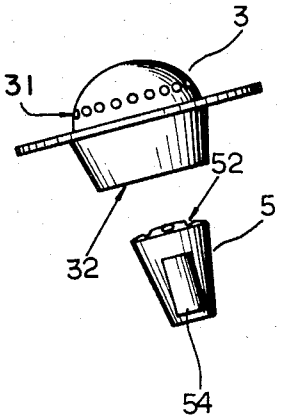
FIG. 4 is an enlarged persective view of the saucer and pneumatic discharge outer end of the pneumatic tube of the air-floating saucer toy of FIG. 1.

A preferred embodiment is described referring to accompanying FIGS. 2, 3, and 4. When turning on the switches (41) and (42) of the control means (4) in FIG. 1, the motor (8) and air pump (7) are activated. The rotational speed of the motor (8) is reduced to 0.5 rpm–1.0 rpm by the speed reducing device (9), then the connected shaft (91) and pneumatic tube (5) are thereby driven to rotate with the same speed of 0.5 rpm–1.0 rpm. Air is compressed by the air pump (7) into high pressure, then passed through the pneumatic conduit (71) into the pneumatic tube (5) within the connector (10) (as shown in FIG. 3). The air passes through the tube (5) and is directed as a pneumatic discharge through the orifices (52) of the nozzle (51) in an upward direction.

The outer end of the pneumatic tube (5) travels in a circular path, with the circular slot (11) of the housing coinciding with and being directly above the path to allow pneumatic discharge from the tube outer end upwardly through the slot to act on the saucer (3), which is thereby urged upwardly to float as a flying saucer above the slot (11). The outer end of the pneumatic tube (5) is inclined slightly in the direction of travel (as shown in FIG. 4) to maintain control of the saucer during circular travel. Further, the saucer (3) is provided with an opening (32) at the bottom so that the pneumatic discharge from the tube end orifices (52) passes through the slot and into this opening (32), thus driving the saucer upward. In order to avoid the sudden movement of the saucer at the beginning, and to provide better control during operation, an annular series of holes (31) is provided in the saucer in communication with the bottom opening (32), thus allowing a limited portion of the pneumatic discharge from the tube end orifices (52) to pass through the small holes (31) with the result that the saucer (3) may smoothly float under the balancing pneumatic action.

When the tube (5) has been driven to rotate, the nozzle (51) of the tube (5) is traveling under the circular slot (11) and the pneumatic discharge is continuously jetted upward along the circular path, thus the saucer (3) is floating along the circular path of the nozzle (51) to give the impression that the saucer is flying along an orbit.

The desirable materials employed in the saucer are generally kinds of light plastic for the purpose of providing ease of suspension in the pneumatic discharge.

When the switch (41) (shown in FIG. 1) is punched to start the electric circuit, the lamp (54) on the pipe (5) begins to emit light. The switch (42) is provided to control the pressure of the pneumatic discharge of the air pump that the saucer may be variably driven.

Although only one saucer (3) is shown in the drawings, it should be understood that a plurality of saucers may be used along with a corresponding number of pneumatic tubes extending radially from the connector (10).

As has been previously stated and readily understood, the purpose of the present invention is to provide a saucer toy wherein the saucer may float along a certain orbit by means of the air pressure. Moreover, the present invention is to provide an air floating saucer toy which may emit sparkle while the saucer is running along the oribit at a variable height.

The present invention has been described in detail above for purposes of illustration only and is not intended to be limited by this description or otherwise to exclude any variation or equivalent arrangement that would be apparent from, or reasonably suggested by, the foregoing disclosure to the skill of the art.

I claim:

1. An air-floating saucer toy, comprising: an air pump; an electric motor; electric batteries for powering said motor and said pump; a speed-reducing device driven by said motor; a connector mounted on said speed-reducing device; a radially extending pneumatic tube journaled through said connector and operably associated with said speed-reducing device for rotation thereby, said tube having an outer end travelling in a generally horizontal circular path and connected pneumatically to said pump through said connector and tube; a housing in which said pump, motor, batteries, speed-reducing device, connector, and tube are contained, said housing having a circular slot coinciding with and superjacent the path of travel of said outer end of said tube; said outer end of said tube opening to said slot for pneumatic discharge therethrough; a saucer disposed for floating above said slot and outer end of said tube under the influence of the pneumatic discharge for spaced disposition above said housing and for generally horizontal circular movement with said end along an orbit corresponding to said circular slot; and control means for controlling operation of said pump and motor.

2. An air-floating saucer toy according to claim 1 and characterized further in that said housing includes a transparent cover enclosing said slot and saucer to prevent inadvertent escape of said saucer.

3. An air-floating saucer toy according to claim 1 and characterized further in that said outer end of said pneumatic tube is in the form of a perforated nozzle facing upwardly to direct the pneumatic discharge upwardly through the slot to said saucer.

4. An air-floating saucer toy according to claim 3 and characterized further in that said perforated nozzle is inclined in the direction of travel of said end of said tube.

5. An air-floating saucer toy according to claim 1 and characterized further in that said pneumatic tube extends into said connector and has holes therein for pneumatic flow of air from said pump through said connector and into said tube.

6. An air-floating saucer toy, comprising: an air pump; an electric motor; electric batteries for powering said motor and said pump; a speed-reducing device driven by said motor; a connector mounted on said speed-reducing device; a radially extending pneumatic tube journaled through said connector and operably associated with said speed-reducing device for rotation thereby, said tube having an outer end travelling in a circular path and connected pneumatically to said pump through said connector and tube; a housing in which said pump, motor, batteries, speed-reducing device, connector, and tubes are contained, said housing having a circular slot coinciding with and superjacent the path of travel of said outer end of said tube; said outer end of said tube opening to said slot for pneumatic discharge therethrough; a saucer disposed for floating above said slot and outer end of said tube under the influence of the pneumatic discharge for spaced disposition above said housing and for circular movement with said end along an orbit corresponding to said circular slot, said saucer having an opening at the bottom thereof for receipt of pneumatic discharge and has an annular series of holes communicating with said bottom opening for passage of a limited portion of said pneumatic discharge therethrough; and control means for controlling operation of said pump and motor.

* * * * *

UNITED STATES PATENT AND TRADEMARK OFFICE

CERTIFICATE OF CORRECTION

PATENT NO. : 4,292,755

DATED : October 6, 1981

INVENTOR(S) : Pin Houn Lin

It is certified that error appears in the above-identified patent and that said Letters Patent is hereby corrected as shown below:

Column 1, line 51, "contrtol" should read -- control --

Column 4, line 43, "tubes" should read -- tube --.

Signed and Sealed this

*Twenty-first* Day of *December 1982*

[SEAL]

*Attest:*

GERALD J. MOSSINGHOFF

*Attesting Officer*

*Commissioner of Patents and Trademarks*